US010787986B2

(12) United States Patent
Kobayashi et al.

(10) Patent No.: US 10,787,986 B2
(45) Date of Patent: Sep. 29, 2020

(54) FUEL PUMP CONTROL DEVICE

(71) Applicant: DENSO CORPORATION, Kariya, Aichi-pref. (JP)

(72) Inventors: Minoru Kobayashi, Kariya (JP); Makoto Asai, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/196,309

(22) Filed: Nov. 20, 2018

(65) Prior Publication Data

US 2019/0186403 A1 Jun. 20, 2019

(30) Foreign Application Priority Data

Dec. 19, 2017 (JP) ..... 2017-242731

(51) Int. Cl.

| | |
|---|---|
| ***F02D 41/38*** | (2006.01) |
| ***F02D 41/14*** | (2006.01) |
| ***F02D 41/10*** | (2006.01) |
| *F02D 41/04* | (2006.01) |
| *F02D 41/08* | (2006.01) |

(52) U.S. Cl.

CPC ..... *F02D 41/3854* (2013.01); *F02D 41/10* (2013.01); *F02D 41/1401* (2013.01); *F02D 41/045* (2013.01); *F02D 41/08* (2013.01); *F02D 2041/1422* (2013.01); *F02D 2200/0602* (2013.01); *F02D 2200/101* (2013.01)

(58) Field of Classification Search

CPC ..... F02D 41/38; F02D 41/3854; F02D 41/10; F02D 41/1401; F02D 41/045; F02D 41/08; F02D 2041/1422; F02D 2200/0602; F02D 2200/101

See application file for complete search history.

(56) References Cited

U.S. PATENT DOCUMENTS

| | | | | |
|---|---|---|---|---|
| 6,672,279 | B2 * | 1/2004 | Nakayama | F01N 3/0231 123/299 |
| 7,634,985 | B2 * | 12/2009 | Parker | F02D 41/3836 123/435 |
| 7,765,991 | B2 * | 8/2010 | Thomas | F02D 41/0032 123/520 |

FOREIGN PATENT DOCUMENTS

| | | | | |
|---|---|---|---|---|
| JP | H09_170467 A | | 6/1997 | |
| JP | 2000282927 A | * | 10/2000 | F02D 41/14 |
| JP | 2008-064053 A | | 3/2008 | |

* cited by examiner

*Primary Examiner* — Hieu T Vo
(74) *Attorney, Agent, or Firm* — Posz Law Group, PLC

(57) ABSTRACT

A fuel pump controller performs a feedback control of an actual fuel pressure of a feed pump to a command fuel pressure which is from an external element. The pump controller changes a gain for the feedback control to a value larger than a minimum value of the gain in response to an acceleration command information which is to accelerate a vehicle by using an internal combustion engine.

12 Claims, 8 Drawing Sheets

FUEL PUMP CONTROL DEVICE

CROSS REFERENCE TO RELATED APPLICATION

This application is based on Japanese Patent Application No. 2017-242731 filed on Dec. 19, 2017, the disclosure of which is incorporated herein by reference.

TECHNICAL FIELD

The present disclosure relates to a fuel pump control device.

BACKGROUND

Conventionally, a fuel pump of a vehicle system draws fuel from a fuel tank, which accumulates fuel, and feeds the fuel to a fuel injection valve via a high-pressure fuel pump for a common rail. When fuel is required, the fuel pump feeds the fuel to the high-pressure fuel pump or the fuel injection valve in response to an operation command.

SUMMARY

The present disclosure relates to a control device of a fuel pump.

According to an aspect of the present disclosure, a fuel pump control device is configured to supply fuel to an internal combustion engine of a vehicle. A control unit performs a feedback control of an actual fuel pressure of the fuel pump to a target fuel pressure.

DETAILED DESCRIPTION

Embodiment

In order for an improvement of a fuel economy, it would be assumable to cause a fuel pump control device to control a fuel pump to autonomously change a discharge amount of the fuel pump in response to a fuel amount required by an internal combustion engine. Inventor has investigated a fuel pump control system to perform a feedback control of an actual fuel pressure to a target fuel pressure received from an external engine ECU or the like. The system may determine a gain related to the feedback control based on a required fuel amount and an environmental temperature. It is assumable that the system would determine the gain to a constant value, even if an environment in a vehicle changes.

Inventor has contemplated a control unit to change a gain, which is used for the feedback control not to be less than a specified minimum value, on receiving an acceleration command information, which is to accelerate a vehicle by using an internal combustion engine of the vehicle.

Hereinafter, embodiments of a fuel pump control device of the present disclosure will be described with reference to the drawings.

First Embodiment

A first embodiment will be described with reference to FIGS. 1 to 5.

<Basic Configuration of Whole of Fuel Injection System 1>

Figure 1:
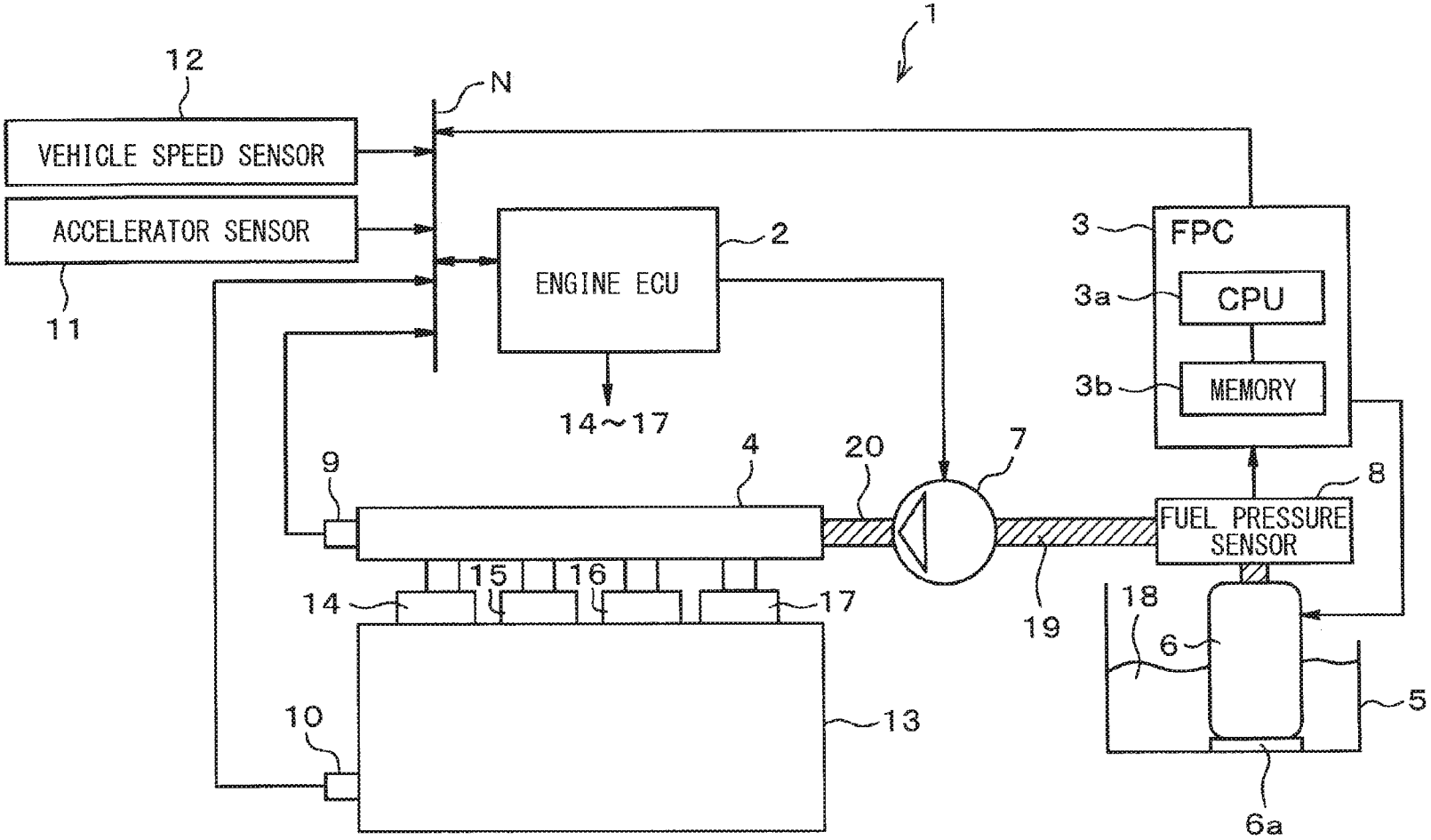
FIG. 1 is a block diagram of a fuel injection system related to a first embodiment.

FIG. 1 shows a block diagram example of a fuel injection system 1 used for a non-hybrid vehicle, that is, so-called a conventional vehicle. This fuel injection system 1 includes main control units of an engine ECU (Electronic control unit) 2 and an FPC (Fuel pump controller) 3. In addition, the fuel injection system 1 includes a combination of a common rail 4, a fuel tank 5, feed pump 6, a high-pressure fuel pump 7, a fuel pressure sensor 8, and various kinds of sensors 9 to 12, an internal combustion engine (also referred to as an engine) 13, and fuel injection valves 14 to 17. The fuel injection valves 14 to 17 are set in respective cylinders of the internal combustion engine 13. The feed pump 6 includes an electric DC pump working as a low-pressure fuel pump to feed fuel 18 under a lower pressure condition as compared with a pressure condition of the high-pressure fuel pump 7.

The vehicle has a network N of, for example, a CAN (controller area network) included therein. This network N is connected to the engine ECU2 and the FPC 3 in addition to the various kinds of sensors 9 to 12. These sensors 9 to 12 include the fuel pressure sensor 9 set in the common rail 4, a crank angle sensor 10 for detecting a rotation angle of a crankshaft in the internal combustion engine 13, and an accelerator pedal sensor 11 set in the vehicle. The sensors 9 to 12 further include an in-tank pressure sensor (not shown in the figure) set in the fuel tank 5 and a vehicle speed sensor 12 set in the vehicle. The crank angle sensor 10 and the accelerator pedal sensor 11 are set as sensors for detecting an operating state of the internal combustion engine 13.

The crank angle sensor 10 sends a crank angle signal every time the crankshaft in the internal combustion engine 13 is rotated by a specified angle. The engine ECU 2 is configured to calculate an engine speed in response to a reception of a crank angle signal of the crank angle sensor 10 via the network N. A main control unit (for example, the engine ECU 2) of the vehicle changes a torque to rotate the crankshaft in response to various kinds of changes caused in the internal combustion engine 13.

The FPC 3 acquires the information of the engine speed from the engine ECU 2 or acquires the crank angle signal via the network N, thereby being able to calculate the engine speed. The accelerator pedal sensor 11 sends an accelerator sensor signal corresponding to a depression amount of an accelerator pedal by a driver. The engine ECU 2 and the FPC 3 are configured to acquire the depression amount of the accelerator pedal and an accelerator opening from this accelerator sensor signal.

Although not shown in the figure, the engine ECU 2 includes a microcomputer and a control IC. The engine ECU 2 receives sensor signals of the various kinds of sensors 9 to 12 received thereto. The engine ECU 2 performs an injection control of the fuel injection valves 14 to 17 and performs pump control processing of the high-pressure fuel pump 7.

The fuel tank 5 accumulates the fuel 18. The feed pump 6 draws the fuel 18 through a filter 6*a* from the fuel tank 5 on the basis of the control performed by the FPC 3 and supplies the fuel 18 to a low-pressure pipe 19. This low-pressure pipe 19 is connected to the high-pressure fuel pump 7 and cause fuel from the fuel tank 5 to flow therethrough. This low-pressure pipe 19 is connected to the fuel pressure sensor 8. The high-pressure fuel pump 7 draws the fuel 18 supplied through the low-pressure pipe 19 and supplies the fuel 18 to the common rail 4 through a high-pressure pipe 20. The common rail 4 accumulates and holds the fuel 18 supplied from the high-pressure fuel pump 7. Further, the common rail 4 has a pressure reducing valve (not shown in the figure) set therein, and when the pressure reducing valve is opened by the control of the engine ECU 2, the fuel 18 in the common rail 4 is returned to the fuel tank 5 through a return pipe (not shown in the figure), and thereby an internal pressure in the common rail 4 is configured to be reduced.

The common rail 4 has the fuel pressure sensor 9 set therein, the fuel pressure sensor 9 detecting a fuel pressure, that is, an actual pressure in the common rail 4. The fuel injection valves 14 to 17 of the respective cylinders are set in the internal combustion engine 13 and are connected to the common rail 4 in parallel. The engine ECU 2 controls an injection of the fuel 18 accumulated in the common rail 4 into the respective cylinders of the internal combustion engine 13 through the fuel injection valves 14 to 17. Each of the fuel injection valves 14 to 17 is a valve of a well-known electromagnetic drive type or a piezo drive type.

<Basic Configuration of FPC 3>

The FCP 3 mainly includes a control logic provided with a CPU 3*a* as a control unit and a memory 3*b* in such a way that the CPU 3*a* performs various kinds of controls on the basis of a program stored in the memory 3*b* as a non-transitory tangible storage medium. The CPU 3*a* performs the program stored in the memory 3*b* thereby to produce a function as a gain changing unit.

This FPC 3 performs a drive control, protection processing, and a diagnosis function of a pump DC motor of the feed pump 6. The FPC 3 is configured to communicate with the engine ECU 2 via the network N and to autonomously draw the fuel 18 from the fuel tank 5. The FPC 3 cause to apply pressure on the fuel 18 on the basis of a command target fuel pressure received from the engine ECU 2 via the network N and to feed the fuel 18 to the high-pressure fuel pump 7 through the low-pressure pipe 19.

When this FPC 3 has the command target fuel pressure received thereto from the engine ECU 2, the FPC 3 performs a feedback control (for example, PID control, PI control, or P control) of an actual fuel pressure of the fuel 18 fed out from the feed pump 6 in response to the command target fuel pressure. At this time, the FPC 3 is configured to perform the feedback control using a feedback gain (for example, P gain, I gain, or D gain) as a parameter.

On the other hand, the high-pressure fuel pump 7 pressure feeds the fuel 18 0 time or 1 time every crank angle 180° CA synchronized with a rotation of a crankshaft in response to a periodic control of the high-pressure fuel pump 7 by the engine ECU 2.

<Control Processing of Feed Pump>

Hereinafter, the basic configuration described above, a characteristic operation and action according to a function will be described with reference to figures following FIG. 2. The engine ECU2 receives sensor information received thereto from the various kinds of sensors 9 to 12 and acquires a driving state and an operating state of the internal combustion engine 13. The engine ECU2 sets a target fuel pressure of the common rail 4 and performs a feedback control of an actual fuel pressure of the common rail 4 detected by the fuel pressure sensor 9 to the target fuel pressure.

At this time, the engine ECU 2 sends the command target fuel pressure to the FPC 3 regularly and periodically. The FPC 3 performs a feedback control of the feed pump 6 with the PID control, the PI control, or the P control in response to the command target fuel pressure received regularly and periodically from the engine ECU 3. The FPC 3 produces the command target fuel pressure from the ECU 2 as quickly as possible and controls the fuel pressure in such a way that the fuel pressure is allowed to temporarily overshoot the command target fuel but is not allowed to undershoot the command target fuel pressure. The FCP 3 performs a feedback control of the fuel pressure by using a parameter of a proportional gain, the so-called P gain as a parameter of the feedback gain.

Figure 2:
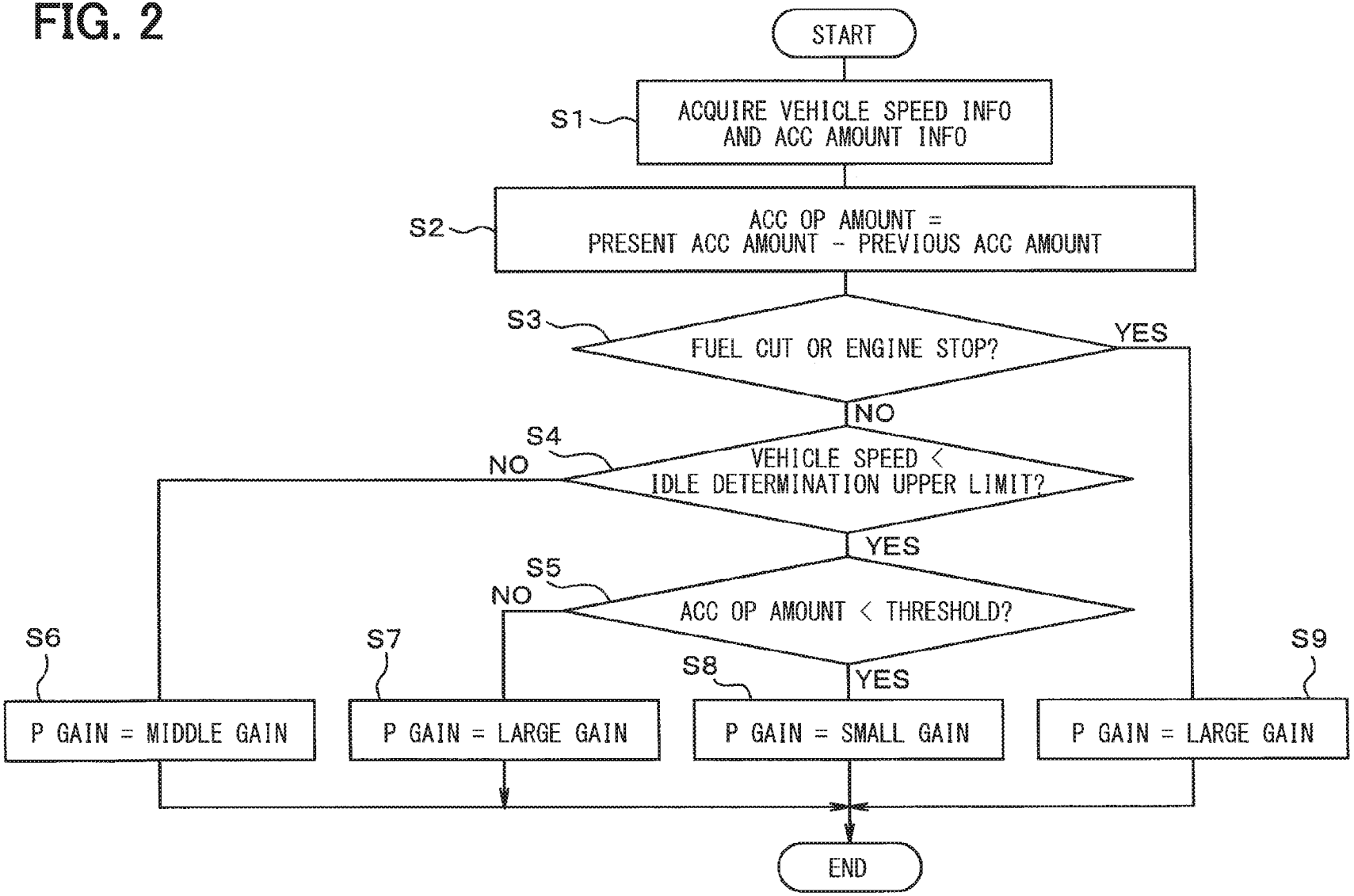
FIG. 2 is a flow chart to describe an operation.

FIG. 2 shows calculation processing of the parameter of the P gain schematically by a flow chart, the calculation processing being performed regularly and periodically when the FPC 3 performs the feedback control processing. As shown in FIG. 2, in S1, the FPC 3 acquires the information of a present vehicle speed from the vehicle speed sensor 12. The FPC 3 further acquires the information of a depression amount of the accelerator pedal from an accelerator sensor signal received from the accelerator pedal sensor 11. Alternatively, the FPC 3 acquires the information of a depression amount of the accelerator pedal from the engine ECU 2. Subsequently, the FCP 3 calculates a difference between the depression amounts of the accelerator pedal which are regularly acquired, thereby calculating a difference between the depression amount of the last time and the depression amount of this time as an accelerator pedal operation amount in S2.

The FPC 3 detects a state of the internal combustion engine 13 from the information of the various kinds of sensors 9 to 12 and detects an operating state of the system according to this information of the state and a state information of an ignition key switch. At this time, the FPC 3 determines whether or not a fuel cut is being performed or whether or not the engine is stopped. If the fuel cut is being performed or if the engine is stopped, the FPC 3 makes a YES determination in S3 and sets the P gain to a large gain constant at a third step among three steps in S9 and terminates the calculation processing. In the processing of S9, the FPC 3 only sets the P gain and performs actual feedback control processing in a later step.

If the FPC 3 determines that the fuel cut is not being performed or that the engine is not stopped, the FPC 3 sets the P gain to a gain constant at any one step among the three steps of large, middle, and small gain constants in response to a vehicle speed information and an accelerator pedal operation amount in S4 to S8.

Figure 3:
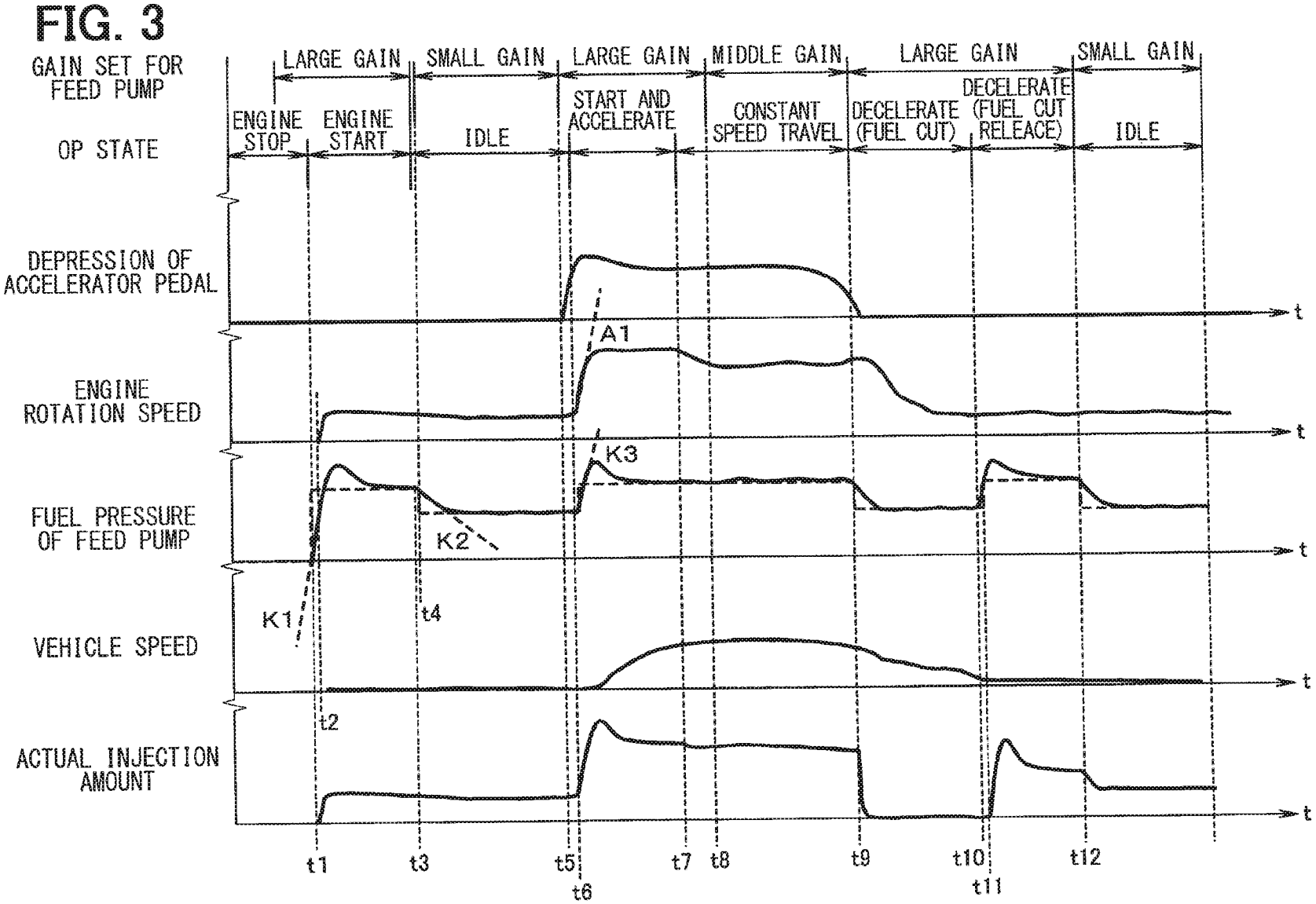
FIG. 3 is a timing chart to describe an operation.

The large gain constant, the middle gain constant, and the small gain constant are specified values. The specified values are set previously stepwise to an intermediate standard value (for example, a median value), a value larger than the median value (for example, a maximum value), and a value smaller than the median value (for example, a minimum value) within a specified gain range set in a series of operating states of the system related to the vehicle control. As shown in FIG. 3, the series of operating states of the system includes an engine stopping state, an engine starting state, an idling state, a starting and accelerating state, a constant speed traveling state, a decelerating state in which the fuel cut is being performed, a decelerating state after deactivating the fuel cut, an idling state, which will be described later. Hereinafter, the description will be made by dividing the operating state of the system into three steps. It is noted that, the operating state of the system may be divided into four steps or more, or may be divided into two steps, or may be continuously changed.

In more detail, when the FPC 3 acquires a vehicle speed information that is larger than an upper limit value of an idling determination vehicle speed, the FPC 3 sets the P gain to the middle gain constant for travel. This middle gain constant is a constant used in a case where the vehicle is not in the idling state but travels at a constant speed. Further, when the accelerator pedal operation amount is a predetermined determination threshold value or larger, the FPC 3 makes a NO determination in S5 and sets the P gain to the large gain constant in S7. On the contrary, when the accelerator pedal operation amount is smaller than the predetermined determination threshold value, the FPC 3 makes a YES determination in S5 and sets the P gain to the small gain constant in S8.

<Actual Control Operation Example of Feed Pump in Conventional Vehicle>

FIG. 3 shows an actual control operation of the feed pump 6 with reference to a timing chart. When an ignition switch is turned on, a battery power is supplied to various kinds of electronic control devices such as the engine ECU 2 and the FPC 3. In this way, the engine ECU 2 and the FPC 3 are activated. The engine ECU 2 performs a control of the internal combustion engine 13 and an injection control of the fuel injection valves 14 to 17. The FPC 3 controls the feed pump 6 in response to the command target fuel pressure sent from the engine ECU 2. At this time, firstly, the FPC 3 sets a parameter necessary for the feedback control processing of the feed pump 6.

After the FPC 3 is supplied with the battery power, the FPC 3 acquires the vehicle speed information to express a speed of the vehicle and acquires an engine speed information of the internal combustion engine 13 in S21 of FIG. 2. If any one of the vehicle speed and the engine speed is 0 or a specified value or less and hence it is determined that the internal combustion engine 13 is stopped, the FPC 3 makes a YES determination in S3 of FIG. 2 and sets the P gain to the large gain constant in S9 of FIG. 2 and waits for the internal combustion engine 13 to be started.

When the ignition switch is turned on, the internal combustion engine 13 is started. At this time, the engine ECU 2 causes the high-pressure fuel pump 7 to supply the fuel 18 to the common rail 4 so as to increase an internal fuel pressure of the common rail 4. The engine ECU 2 further sends the command target fuel pressure to the FPC 3 at a timing t1 shown in FIG. 3.

Subsequently, at the time of starting the engine, the engine ECU 2 controls the internal combustion engine 13 in such a way that the engine speed becomes an idling speed within a specified range at a timing t2 shown in FIG. 3 and the fuel injection valves 14 to 17 injects the fuel 18. When the fuel 18 is injected into the internal combustion engine 13 from the fuel injection valves 14 to 17, the internal fuel pressure in the common rail 4 is reduced. The engine ECU 2 controls the high-pressure fuel pump 7. At this time, when the FPC 3 has the command target fuel pressure received thereto from the engine ECU 2, the FPC 3 performs the feedback control of the actual fuel pressure of the feed pump 6 in such a way that the actual fuel pressure of the feed pump 6 becomes the command target fuel pressure according to a detection result of the fuel pressure sensor 8. At this time of starting the engine, the P gain is set to the large gain constant, so even if an actual injection amount is increased rapidly, the actual fuel pressure of the feed pump 6 also follows and increases quickly in accordance with the actual injection amount. Refer to an increase gradient K1 shown in FIG. 3.

Thereafter, when the operating state of the internal combustion engine 13 is brought into the idling state, the FPC 3 detects the operating state of the internal combustion engine 13 being the idling state. In this case, the FPC 3 makes a NO determination in S3 of FIG. 2 and makes a YES determination in S4 and makes a YES determination in S5, thereby setting the P gain to the small gain constant in S8. Thereafter, the engine ECU 2 commands the FPC 3 to reduce the command target fuel pressure of the feed pump 6. Refer to timings t3, t4 shown in FIG. 3.

At this time, the FPC 3 performs the feedback control of the actual fuel pressure of the feed pump 6 in such a way as to coincide with the command target fuel pressure. In this idling state, the FPC 3 sets the P gain to the small constant in S8 before the FPC 3 receives a command to reduce the command target fuel pressure from the ECU 2. In this way, the FPC 3 does not control the feed pump 6 sensitively to a variation in the actual fuel pressure detected by the fuel pressure sensor 8. Refer to a decrease gradient K2 shown in FIG. 3.

In this regard, the high-pressure fuel pump 7 is arranged after the feed pump 6. When the high-pressure fuel pump 7 pressure feeds the fuel 18 to the common rail 4, the high-pressure fuel pump 7 increases or decreases the pressure in a pressurizing chamber (not shown in the figure) in conjunction with the rotation of the crankshaft thereby to draw the fuel 18 from the low-pressure pipe 19 and pressure feeds the fuel 18 to the common rail 4 through the high-pressure pipe 20. At this time, the fuel pressure accumulated in the low-pressure pipe 19 which connects the feed pump 6 to the high-pressure fuel pump 7 is varied and pulsated. However, in this idling state, the FPC 3 does not control the feed pump 6 sensitively to a variation in the actual fuel pressure detected by the fuel pressure sensor 8, Therefore, the FPC 3 is configured to reduce an effect of the variation in the fuel pressure in the low-pressure pipe 19. As a result, the configuration enables to reduce an effect of the pulsation of the fuel pressure and to improve a drive feeling.

Thereafter, the driver depresses the accelerator pedal so as to start the vehicle in the idling state. When the accelerator pedal is depressed, the accelerator pedal operation amount is quickly increased. For this reason, in S5 of FIG. 2, the accelerator pedal operation amount is made more than a specified determination threshold value. At this time, information to indicate that the accelerator pedal operation amount is made more than the specified determination threshold value is received to the engine ECU 2 and the FPC 3 as acceleration command information. Subsequently, the FPC 3 makes a NO determination in S5 and sets the P gain to the large gain constant in S7. Refer to a timing t5 shown in FIG. 3.

On the other hand, while increasing the engine speed of the internal combustion engine 13 according to the information of the accelerator pedal operation amount by the accelerator sensor signal of the accelerator pedal sensor 11, the engine ECU 2 causes the fuel injection valves 14 to 17 to inject the fuel 18 in such a way as to increase a fuel injection amount per unit time.

The fuel pressure in the common rail 4 reduces due to increase in the actual injection amount of the fuel 18. Therefore, the engine ECU 2 activates the high-pressure fuel pump 7 and commands the feed pump 6 to increase the command target fuel pressure. Refer to a timing t6 shown in FIG. 3. The FPC 3 sets the P gain to the large gain constant at the timing t5 before the timing t6, so the FPC 3 is enabled to control the feed pump 6 sensitively in good followability to the variation in the actual fuel pressure detected by the fuel pressure sensor 8 and hence to quickly control the actual fuel pressure of the feed pump 6 to a large fuel pressure of the command target fuel pressure or more.

Hence, even if the engine speed is increased greatly in response to a large speed increase gradient A1 (see FIG. 3) for a large engine speed, the FPC 3 is configured to quickly control the actual fuel pressure of the feed pump 6 in such a way as to follow the engine speed corresponding to the large speed increase gradient A1. Refer to an increase gradient K3 shown in FIG. 3.

In this way, the operating state reaches the starting and accelerating state. Even if the operating state is shifted to the starting and accelerating state and a fuel consumption is greatly increased, the feed pump 6 is configured to follow up this increase in the fuel consumption and is enabled to supply the fuel 18 to the high-pressure fuel pump 7 through the low-pressure pipe 19.

Subsequently, when the vehicle speed is increased, the driver decreases a depression amount of the accelerator pedal. When the driver keeps the depression amount of the accelerator pedal at a constant amount at a timing t7 shown in FIG. 3 to make the vehicle travel at a constant speed, the engine speed is made smaller than the engine speed at the time of the acceleration. Refer to a timing t8 shown in FIG. 3. In this constant speed traveling state, the FPC 3 makes a NO determination in S3 of FIG. 3 and makes a NO determination in S4 of FIG. 3 and sets the P gain to the middle gain constant.

Subsequently, when the driver decreases the depression amount of the accelerator pedal to zero at a timing t9 shown in FIG. 3, in a period of the timing t9 to a timing t10 shown in FIG. 3, the engine ECU2 performs a fuel-cut control to stop supplying the fuel 18 to the fuel injection valves 14 to 17, thereby reducing an actual injection amount injected from the fuel injection valves 14 to 17 substantially to zero. In this way, the so-called engine brake is applied to the vehicle, and hence the vehicle decreases its speed, and the engine decreases its speed to a specified speed (for example, a specified speed determined in the idling state).

Meanwhile, the engine ECU 2 commands the FPC 3 to reduce the target fuel pressure at the timing t9. On the other hand, the FPC 3 makes a YES determination in S3 of FIG. 2 and sets the P gain to the large gain constant. The FPC 3 reduces the target fuel pressure and performs the feedback control of the actual fuel pressure of the feed pump 6.

Here, the reason why the P gain is set to the large gain constant is that the large gain constant is necessary for preparing a sudden increase in the injection amount related to a restart of the internal combustion engine 13 at the time of releasing the fuel cut thereafter or for preparing an input of an acceleration command information related to a subsequent sudden start and acceleration.

When the engine ECU 2 releases the fuel cut control, the engine ECU 2 starts to cause the fuel injection valves 14 to 17 to inject the fuel 18 thereby to restart the internal combustion engine 13. At this time, when the fuel 18 is suddenly supplied to the fuel injection valves 14 to 17 from the common rail 4, a consumption amount of the fuel 18 is suddenly increased. Subsequently, a decrease of pressure in the common rail 4 is caused and hence the ECU 2 commands the FPC 3 to increase the command target fuel pressure. Further, in a case where the driver depresses the accelerator pedal to make a sudden acceleration, to respond to this sudden acceleration, the engine ECU 2 supplies the fuel 18 to the fuel injection valves 14 to 17 from the high-pressure fuel pump 7 through the common rail 4 and commands the FPC 3 to suddenly increase the command target fuel pressure.

At this time, if the FPC 3 delays control processing for the sudden increase of the command target fuel pressure related to the sudden acceleration of the engine ECU 2, the engine ECU 2 may be incapable of increasing the engine speed of the internal combustion engine 13 quickly, and the situation may not be preferable. For this reason, when the FPC 3 determines that the fuel cut is being performed, the FPC 3 sets the P gain to the large gain constant at the timing t9 thereby to prepare to respond to control processing at the time of releasing the fuel cut thereafter and control processing at the time of the sudden acceleration. During the fuel cut shown during the period from the timing t9 to the timing t10, the FPC 3 is configured to control the feed pump 6 sensitively to a variation in the actual fuel pressure detected by the fuel pressure sensor 8 because the P gain is set to the large gain constant.

Thereafter, when a specified condition (for example, the engine speed is decreased to a specified speed) is satisfied, at the timing t10 shown in FIG. 3, the ECU 2 terminates the fuel cut control. When the ECU 2 terminates the fuel cut control, the ECU 2 commands the FPC 3 to increase the target fuel pressure, so the FPC 3 performs the feedback control of the actual fuel pressure so as to cause the actual fuel pressure to coincide with the target fuel pressure. Thereafter, at a timing t11 shown in FIG. 3, the engine ECU 2 restarts supplying fuel to the fuel injection valves 14 to 17 thereby to start injection processing to the internal combustion engine 13. In this way, an actual injection amount of the fuel 18 is increased and hence the FPC 3 is configured to control the feed pump 6 sensitively for the variation in the actual fuel pressure detected by the fuel pressure sensor 8.

Also after that, if the driver does not depress the accelerator pedal again, the engine speed is held and the operating state of the engine is shifted to the idling state at a timing t12 shown in FIG. 3. When the operating state of the engine is shifted to the idling state, the ECU 2 commands the FPC 3 to reduce the command target fuel pressure. The FPC 3 makes a NO determination in S3 of FIG. 2 and makes YES determinations in S4 and S5 of FIG. 2 and sets the P gain to the small gain constant and performs the feedback control of the actual fuel pressure so as to coincide with the command target fuel pressure. In this way, the configuration enables to perform the series of steps of the control processing.

Comparative Example

<Setting P Gain to Large Gain Constant in all Operating States>

Figure 4:
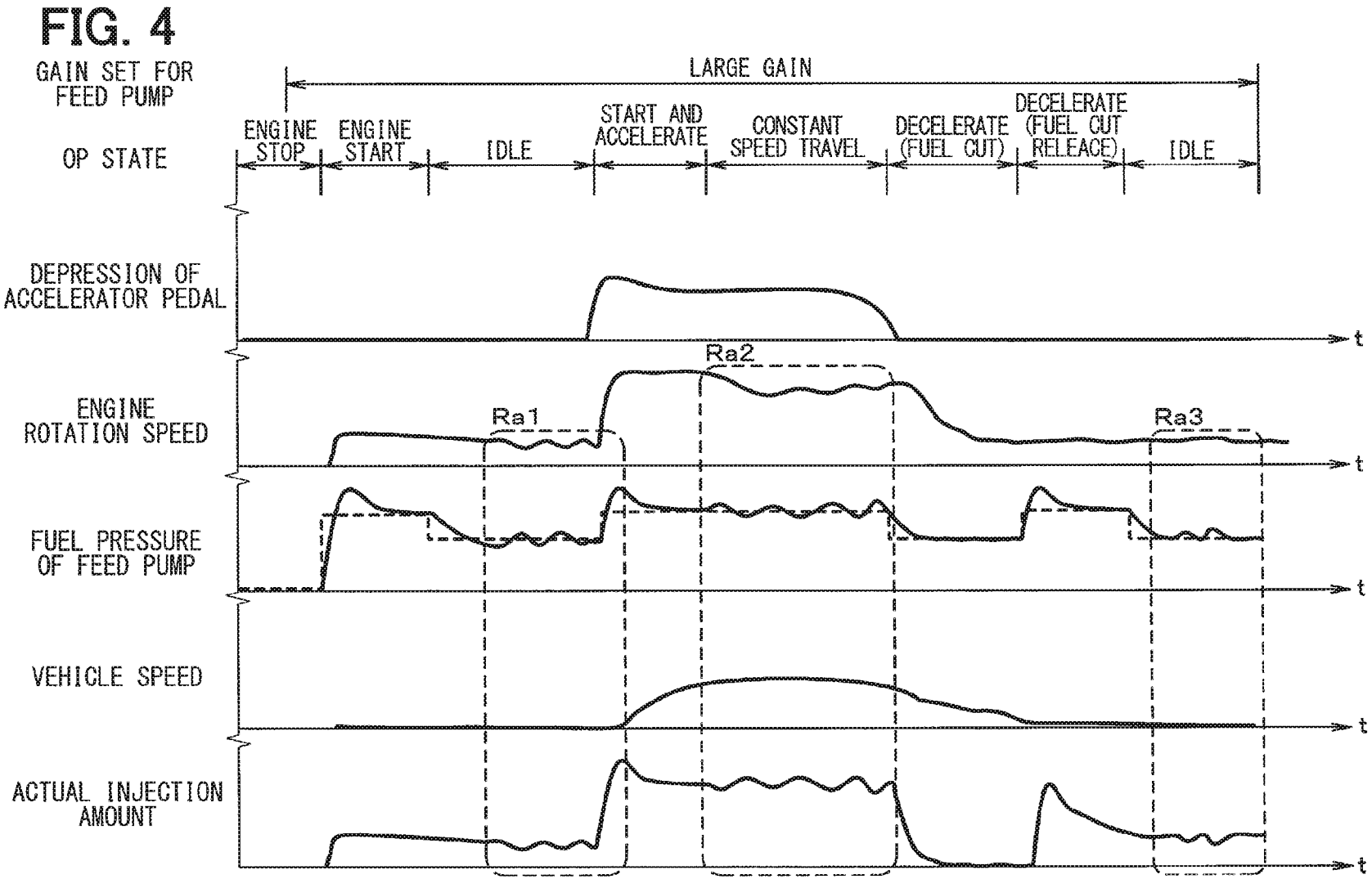
FIG. 4 is a timing chart to show a comparative example in correspondence to FIG. 3.

FIG. 4 shows a change in each value in a case where, for example, the same configuration as the FPC 3 performs the series of steps of the vehicle control processing with the P gain set to the large gain constant as a comparative example. "The large gain constant" at this time is, for example, a constant determined by a typical temperature of the fuel 18.

An operation when the operating state is the idling state is shown in ranges Ra1, Ra3 shown in FIG. 4. As shown in these ranges Ra1 or Ra3, in particular, when the operating state is the idling state, if the FPC 3 sets the P gain to the large gain constant, the actual fuel pressure of the feed pump 6 is greatly varied up and down with respect to the command target fuel pressure of the engine ECU 2 as a center. Subsequently, an actual injection amount of each of the fuel injection valves 14 to 17 is varied up and down in response to the actual fuel pressure of the feed pump 6, so the engine speed is also varied greatly and hence a stability of the operation would be impaired.

An operation when the operating state is the constant speed traveling state is shown in the range Ra2 shown in FIG. 4. As shown in this range Ra2, when the operating state is the constant speed traveling state, if the FPC 3 sets the P gain to the large gain constant as shown in the range Ra2, the actual fuel pressure of the feed pump 6 is greatly varied up and down with respect to the command target fuel pressure of the engine ECU 2 as a center, as is the case with the idling state. Consequently, the actual injection amount and the engine speed are also varied greatly and hence the stability of the operation would be impaired.

<Setting P Gain to Small Gain Constant in all Operating States>

Figure 5:
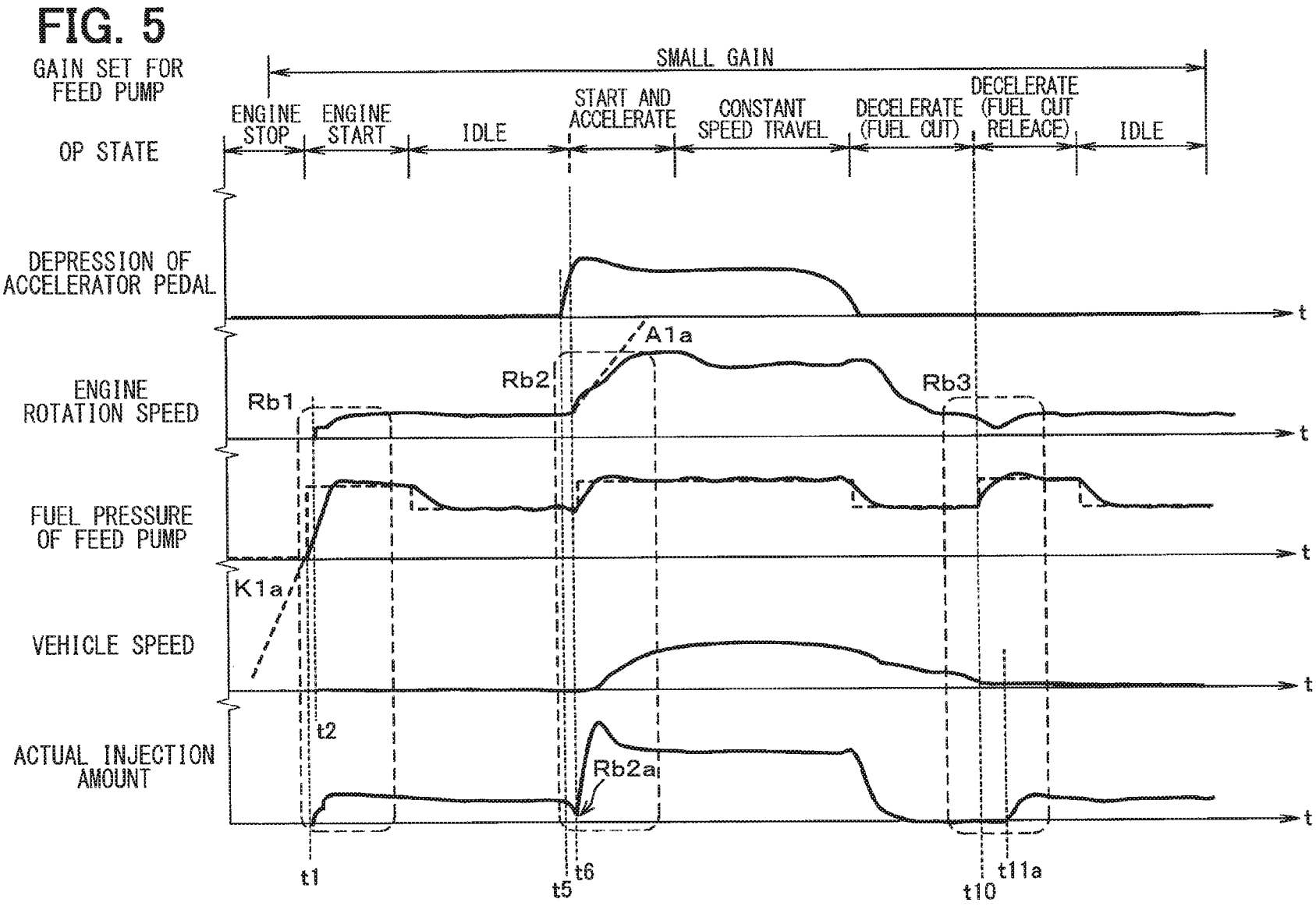
FIG. 5 is a timing chart to show a comparative example in correspondence to FIG. 3.

On the other hand, FIG. 5 shows a change in each value in a case where the FPC 3 performs the series of steps of the vehicle control processing with the P gain set to "the small gain constant".

An operation when the operating state is the engine starting state is shown in a range Rb1 shown in FIG. 5. In this range Rb1, if the FPC 3 sets the P gain to the small gain constant, the actual fuel pressure of the feed pump 6 cannot quickly follow the command target fuel pressure of the engine ECU 2. Refer to an initial gradient K1*a* of the comparative example. Subsequently, in some cases, the engine ECU 2 requires more time than necessary for starting the internal combustion engine 13. An operation when the operating state is the starting and accelerating state is shown in a range Rb2 shown in FIG. 5. When the operating state is the starting and accelerating state, a fuel consumption is greatly increased and the fuel injection amount is greatly increased. If the actual fuel pressure of the feed pump 6 cannot quickly follow the command target fuel pressure of the engine ECU2, as shown in the range Rb2, the actual injection amount of the fuel is greatly lowered at an initial stage of the starting and accelerating state and hence an increase in the engine speed is also lowered. Refer to an initial gradient A1*a* of the engine speed.

Further, an operation when the operating state changes from a state where a fuel cut is started to a state where the fuel cut is released is shown in a range Rb3 shown in FIG. 5. If the FPC 3 sets the P gain to the small gain also in this period of fuel-cut releasing timing from t10 to t11*a*, when the actual fuel pressure of the feed pump 6 cannot quickly follow up the command target fuel pressure of the engine ECU 2, a timing when the fuel injection is started substantially will be delayed. Refer to a timing t11*a* of the range Rb3 shown in FIG. 5. In preparation for this case, as described above, it would be desired that the P gain is changed actively.

Effect of Present Embodiment

As described above, according to the present embodiment, the FPC 3 performs the feedback control of the actual fuel pressure of the feed pump 6 in response to the command target fuel pressure received from the external engine ECU 2. When the FPC 3 has an acceleration command information received thereto, the FPC 3 makes a YES determination in S4 of FIG. 2 and makes a NO determination in S5 of FIG. 2 and greatly changes the P gain, for example, to the large gain constant. For this reason, the FPC 3 is configured to set the suitable P gain in response to the acceleration command information.

Further, when the FPC 3 has an acceleration command information received thereto at the timing t5 shown in FIG. 3 before the FPC 3 has an increase command of the command target fuel pressure received by the engine ECU2 at the timing t6 shown in FIG. 3, the FPC 3 makes a YES determination in S4 of FIG. 2 and makes a NO determination in S5 of FIG. 2 and greatly changes the P gain, for example, to the large gain constant. For this reason, the FPC 3 expects the command target fuel pressure to be changed by the engine ECU2 and enables to change the P gain to the large gain constant in advance. Subsequently, even when the FPC 3 has an increase command of the command target fuel pressure received thereto from the engine ECU 2 at the timing t6 shown in FIG. 3, the FPC 3 is enabled to control the feed pump 6 sensitively in excellent following capability in response to a variation in the actual fuel pressure detected by the fuel pressure sensor 8 and hence to quickly control the actual fuel pressure of the feed pump 6 to a fuel pressure larger than the command target fuel pressure.

When it is determined that the internal combustion engine 13 is stopped based on a vehicle speed information obtained from the vehicle speed sensor 12 or an engine speed information of the internal combustion engine 13, the FPC 3 sets the P gain to the large gain constant at the timing t0. For this reason, the FPC 3 is configured to expect a subsequent increase command of the command target fuel pressure and to change the P gain to the large gain constant in advance. Subsequently, even when the FPC 3 has the increase command of the command target fuel pressure received thereto from the engine ECU 2 at the timing t1 shown in FIG. 3, the FPC 3 is configured to control the feed pump 6 sensitively in an excellent following capability in response to a variation in the actual fuel pressure detected by the fuel pressure sensor 8 and hence to quickly control the actual fuel pressure of the feed pump 6 to a fuel pressure larger than the command target fuel pressure.

When it is determined that the operating state is a state in which the fuel cut is being performed, the FPC 3 changes the P gain to the large gain constant. Therefore, when an increase in the fuel injection amount caused by a subsequent restart of the internal combustion engine 13 or an acceleration command information related to a subsequent rapid start and acceleration is received to the FPC 3, the FPC 3 is enabled to quickly respond to the increase in the injection amount or to the acceleration command information within a sufficiently short time. In this way, the FPC 3 is enabled to sensitively and quickly control the actual fuel pressure of the feed pump 6 to a fuel pressure larger than the command target fuel pressure.

When the operating state is the constant speed traveling state, the internal combustion engine 13 rotates the crankshaft at a constant torque of a degree exceeding the idling state, and in order to keep the constant torque of this middle degree, the FPC 3 sets the P gain to the middle gain constant. For this reason, the FPC 3 is enabled to keep a moderate response to a variation in the actual fuel pressure of the feed pump 6. In the idling state, the internal combustion engine 13 rotates the crankshaft by a comparatively small constant torque. In this case, and the FPC 3 sets the P gain to the small gain constant in the idling state. In this way, the FPC 3 is enabled to hold a suitable response to the variation in the actual fuel pressure of the feed pump 6 and hence to control the feed pump 6 in such a way that the actual fuel pressure of the feed pump 6 is not greatly vibrated.

Second Embodiment

Figure 6:
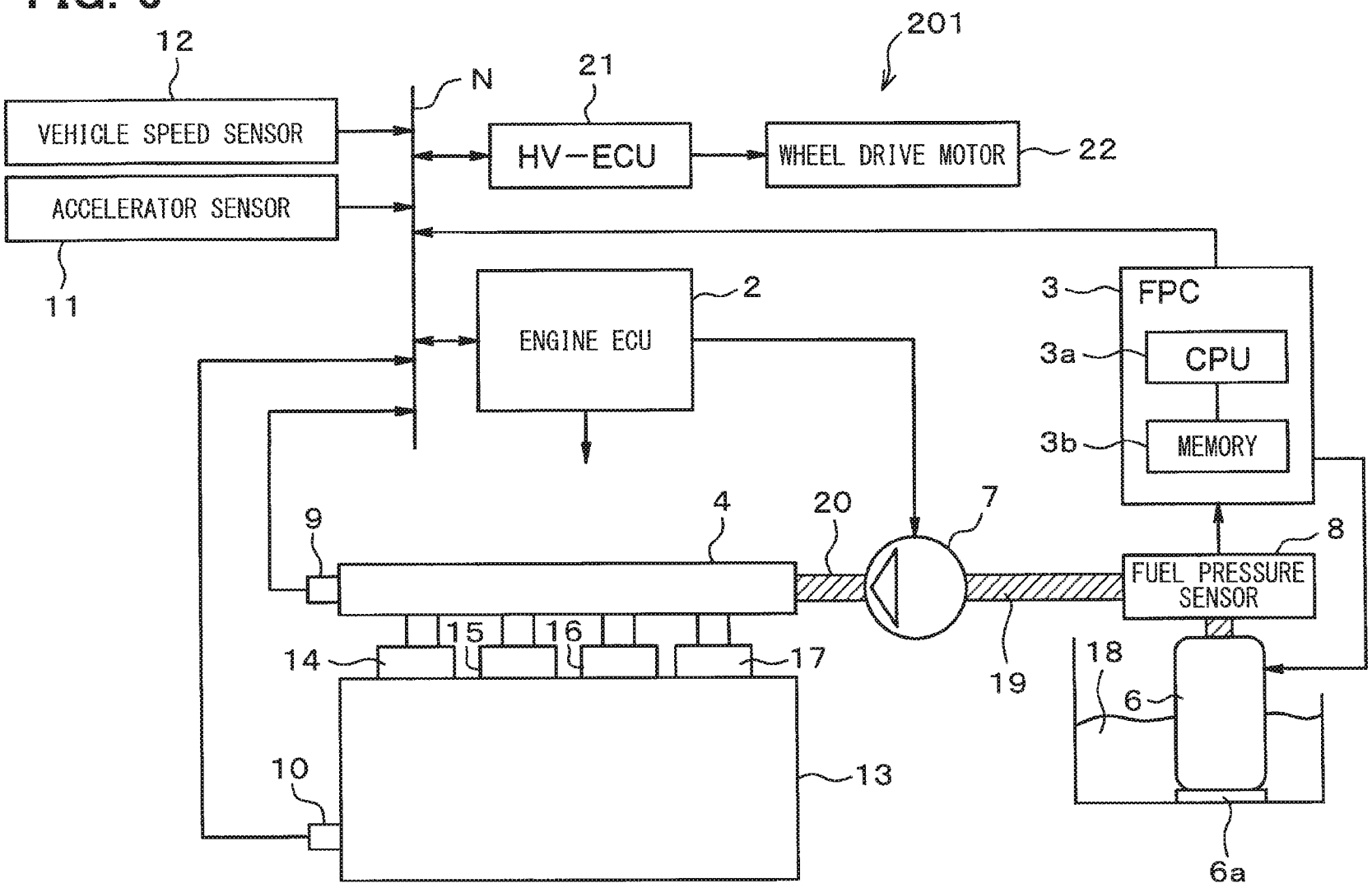
FIG. 6 is a block diagram of a fuel injection system related to a second embodiment.
Figure 7:
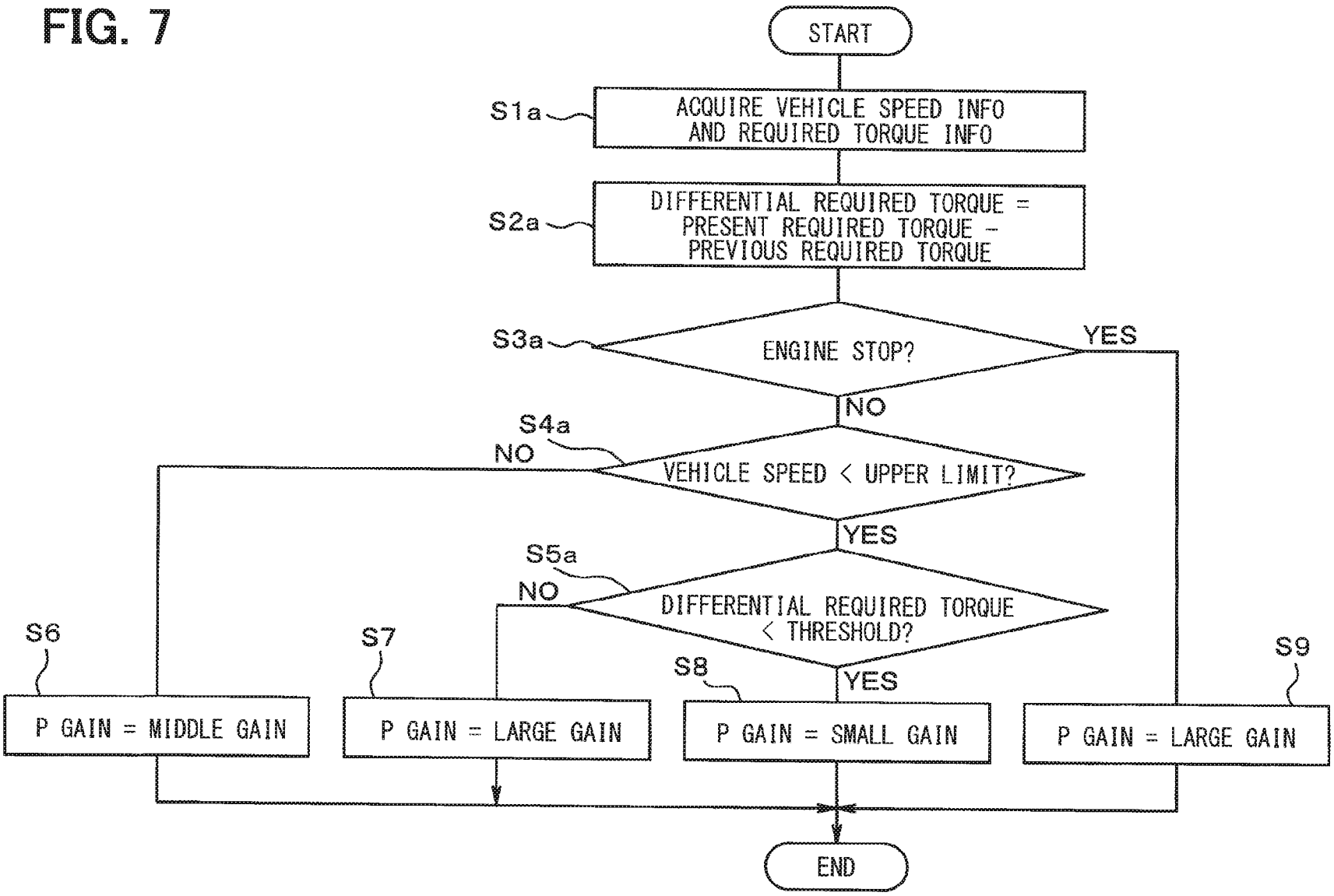
FIG. 7 is a flow chart to describe an operation.
Figure 8:
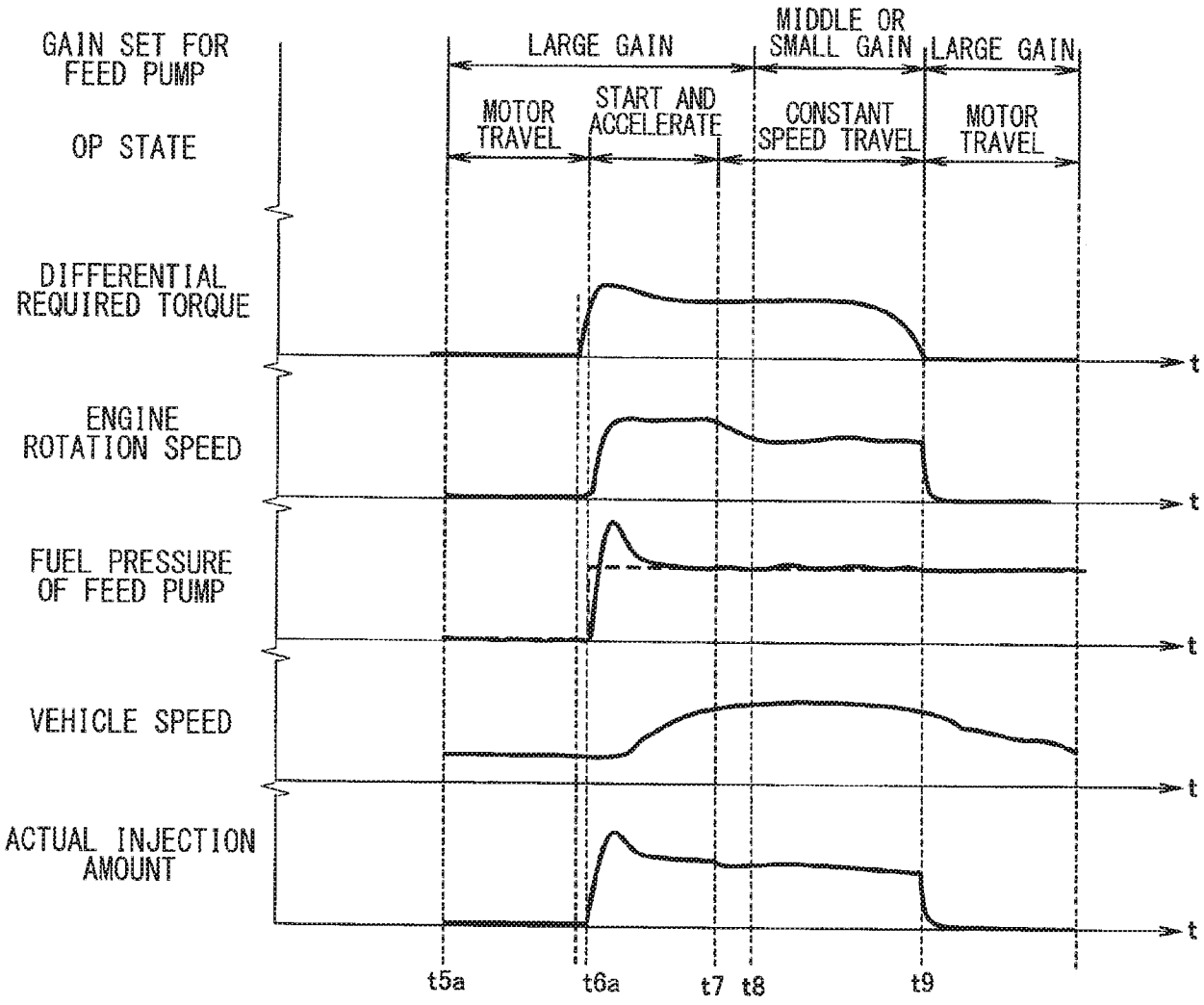
FIG. 8 is a timing chart to describe an operation.

FIGS. 6 to 8 show additional figures to describe a second embodiment. FIG. 6 shows a specific example of a configuration of a vehicle control system 201 to replace the fuel injection system 1 shown in FIG. 1. This vehicle control system 201 is provided with a configuration related to a hybrid vehicle control in addition to the fuel injection system 1 described in the first embodiment.

As shown in FIG. 6, a network N is connected to a hybrid ECU (hereinafter referred to as an HVECU) 21. This hybrid ECU 21 is an ECU for a hybrid control having a microcomputer (not shown in the drawing) provided with a CPU and a memory as a control main body and is included in such a way that the ECU 21 receives various kinds of information carried through the network N. The various kinds of information includes, for example, output information of the engine ECU 2 and the FPC 3, and sensor information such as the accelerator pedal 11 and the vehicle speed sensor 12. The hybrid ECU 21 controls a wheel drive motor 22 on the basis of these information.

When the HVECU 21 and the engine ECU 2 control the wheel drive motor 22 and the internal combustion engine 13, respectively, the HVECU 21 and the engine ECU 2 send and receive various kinds of information between them and control the wheel drive motor 22 and the internal combustion engine 13 in cooperation. The HVECU 21 adds a torque for rotating and driving the wheel drive motor 22 and a required torque, which is required of the engine ECU 2 by the internal combustion engine 13, and controls these torques to a target torque in an integrated manner. If a necessary torque is larger than the torque for rotating and driving the wheel drive motor 22, an engine drive request signal including a required torque information is sent as an acceleration command information to the engine ECU 2.

When the engine ECU 2 receives this engine drive request signal, the engine ECU 2 controls the internal combustion engine 13 by using the required torque information included in the engine drive request signal. In the present embodiment, the FPC 3 receives the engine drive request signal sent to the engine ECU 2 from the HVECU 21 and controls the P gain by using the engine drive request signal.

Hereinafter, this specific example will be described. Although shown also in the first embodiment, the engine ECU 2 has sensor information received thereto from the various kinds of sensors 9 to 12 and sets the target fuel pressure of the common rail 4 by using the driving state and the operating state of the internal combustion engine 13. The engine ECU 2 performs the feedback control of the actual fuel pressure of the common rail 4 detected by the fuel pressure sensor 8 to the target fuel pressure. At this time, the engine ECU 2 sends the command target fuel pressure to the FPC 3 periodically. The FPC 3 performs the feedback control of the actual fuel pressure of the feed pump 6 so as to produce the command target fuel pressure from the engine ECU 2 as quickly as possible.

FIG. 7 schematically shows calculation processing of a parameter of the P gain, which is periodically performed when the feedback control processing is performed, by using a flow chart.

In S1*a*, the FPC 3 acquires present vehicle speed information from the vehicle speed sensor 12 and acquires an engine drive request signal from the HVECU 21 and acquires a required torque information included in this engine drive request signal. Subsequently, the FPC 3 calculates a difference between the required torques acquired periodically thereby to calculate a difference between the required torque at the last time and the required torque at this time as a differential required torque in S2*a*.

Subsequently, the FPC 3 detects the operating state of the internal combustion engine 13 by using the information of the various kinds of sensors 9 to 12 and determines in S3*a* whether or not the engine is stopped. If the engine is stopped, the FPC 3 makes a YES determination in S3*a* and sets the P gain to a large gain constant at the third step of three steps in S9 and terminates the calculation processing. At this time, in the processing of S9, the FPC 3 only sets the P gain and actual feedback control processing is performed later.

If the FPC 3 determines in S3*a* that the engine is not stopped, the FPC 3 should set the P gain to a gain constant at any one step of three steps of large, middle, and small gain constants according to the vehicle speed information and a value of the differential required torque in S4 to S8. The FPC 3 may set the P gain to any one of two steps or four steps or in a stepless manner as is the case with the above-mentioned embodiment.

In more detail, when the vehicle speed information, which is detected by the vehicle sensor 12 and is acquired by the FPC 3, is an upper limit value of the vehicle speed threshold value or more, the FPC 3 sets the P gain to the middle gain constant for travel in S6. This middle gain constant is a gain constant used in a case where the vehicle travels at a constant speed while driving the internal combustion engine 13 by using the fuel 18.

Further, when the differential required torque is a differential torque threshold value set in advance or more, the FPC 3 makes a NO determination in S5*a* and sets the P gain to a large gain constant in S7. Conversely, when the differential required torque is smaller than the differential torque threshold value set in advance, the FPC 3 makes a YES determination in S5*a* and sets the P gain to a small gain constant in S8. In other words, when the required torque required of the engine ECU 2 from the HVECU 21 in S5*a* is an amount of variation of a specified value or more, the FPC 3 sets the P gain to a large gain constant in S7, and in other cases, the FPC 3 sets the P gain to a small gain constant in S8.

<Actual Control Operation Example of Feed Pump in Hybrid Vehicle>

FIG. 8 shows a timing chart to replace FIG. 3. A detailed operation description is almost the same as a case where "acceleration pedal operation amount" of the first embodiment is replaced with "differential required torque". For this reason, the detailed operation description will be omitted if necessary.

When the HVECU 21 drives the wheel drive motor 22 thereby to make the vehicle travel by the motor, the HVECU 21 controls a required torque, which is required of the engine ECU 2, to 0 or to within a specified range. For this reason, when the vehicle travels by the motor, the differential required torque calculated in S2*a* shown in FIG. 7 becomes almost 0. At this time, the FPC 3 determines in S3*a* that the engine is stopped and makes a YES determination in S3*a* and sets the P gain to the large gain constant in S9. In this state where the vehicle travels by the motor, the FPC 3 sets the P gain to the large gain constant, so the FPC 3 is configured to prepare a subsequent rapid acceleration in advance. Refer to a timing t5*a* shown in FIG. 8. Subsequently, for example, when the operating state is shifted to the starting and accelerating state and the HVECU 21 rapidly increases the required torque required of the ECU 2, the differential required torque becomes more than a specified differential torque threshold value in S5*a* shown in FIG. 7.

On the other hand, the engine ECU 2 injects the fuel from the fuel injection valves 14 to 17 so as to increase the fuel injection amount per unit time while increasing the engine speed of the internal combustion engine 13 in response to the required torque information included in the engine drive request signal. The engine ECU 2 increases the actual injection amount of the fuel 18. Since the fuel pressure in the common rail 4 is decreased at this time, the engine ECU 2 operates the high-pressure fuel pump 7 and commands the feed pump 6 to increase the command target fuel pressure. Refer to a timing t6*a* shown in FIG. 8.

The FPC 3 sets the P gain to the large gain constant at the timing t5*a* before the timing t6*a*, so the FPC 3 is configured to control the feed pump 6 sensitively in an excellent following capability in response to a variation in the actual fuel pressure detected by the fuel pressure sensor 8 and hence to quickly control the actual fuel pressure of the feed pump 6 to a fuel pressure larger than the command target fuel pressure. In this way, the operating state reaches to the starting accelerating state. Since the operating state reaches to the starting and accelerating state, even if a consumed fuel increases greatly, the feed pump 6 is configured to follow up an increase in the consumed fuel and to supply the fuel 18 to the low-pressure pipe 19 and therefore to the high-pressure fuel pump 7.

Subsequently, in the constant speed traveling state after the timing t8, the FPC 3 makes a NO determination in S3*a* of FIG. 8 and then makes a NO determination in S4*a* of FIG. 8 and sets the P gain to the middle gain constant. The operation after that is almost the same as the embodiment described above, so the detailed description will be omitted.

As described above, according to the present embodiment, the FPC 3 has the acceleration command information received thereto by the engine drive request signal, the FPC 3 greatly changes the P gain, for example, to the large gain constant. For this reason, the FPC 3 is configured to set a suitable P gain in response to the acceleration command information by the engine drive request signal. As to the other operation and effect, the same operation and effect as the embodiment described above will be produced.

Other Embodiments

The present disclosure is not limited to the embodiments described above but may be modified or expanded, for example, as shown in the following.

There have been shown embodiments in which the fuel 18 is supplied to the common rail 4 from the fuel tank 5 through the feed pump 6 and the high-pressure fuel pump 7 and in which the fuel 18 is supplied to the fuel injection valves 14 to 17 from the common rail 4. However, the present disclosure is not limited to the embodiments.

For example, the present disclosure may be applied also to a mode in which the fuel 18 is directly supplied to the fuel injection valves 14 to 17 through one pump 6. Further, a mode in which special processing is performed to the control of the feed pump 6 has been shown in the embodiments described above, but the present disclosure is not limited to the mode. In a case where the configuration of the embodiments described above is employed, special processing may be performed to the control of the high-pressure fuel pump 7.

There have been shown the embodiments in which the feed pump 6 is controlled by using the parameter of the P gain as a parameter of a feedback gain, but it is also recommended to employ a mode in which the feed pump 6 is controlled by using a parameter of an integral gain, that is, an I gain, or to employ a mode in which the feed pump 6 is controlled by using a parameter of a differential gain, that is, a D gain. Alternatively, the feed pump 6 may be controlled by a combination of a P control, an I control, and a D control. Still further, in a case where the other feedback control is used, the feedback control of the feed pump 6 may be performed by using a gain parameter of the feedback control.

Further, there have been shown the embodiments in which the feed pump 6 is controlled by using the parameter of the P gain as a parameter of a feedback gain, but it is also recommended that a calculation (for example, a multiplication) of a gain correction coefficient with respect to the parameter of the P gain is performed thereby to calculate a parameter of the P gain. The gain correction coefficient at this time may be found by calculating any one parameter of the operation amount of the accelerator pedal, the vehicle speed, and the depression amount of the accelerator pedal.

At this time, it is desired that: a map of the gain correction coefficients corresponding to changes in the operation amount of the accelerator pedal, the vehicle speed, and the depression amount of the accelerator pedal is stored in the memory 3*b* of the FPC 3; the gain correction coefficient corresponding to each change in the operation amount of the accelerator pedal, the vehicle speed, and the depression amount of the accelerator pedal is calculated from the map; and this gain correction coefficient is calculated thereby to calculate a parameter of the P gain.

There have been shown the embodiments in which the P gain related to the feedback control by the FPC 3 is changed to the large, middle, or small gain constant among three steps in the series of steps of the vehicle control (that is, the engine stopping state, the engine starting state, the idling state, the starting and accelerating state, the constant speed traveling state, the decelerating state during the fuel cut, the decelerating state after releasing the fuel cut, and the idling state). However, the present disclosure is not limited to this but may be also applied to a mode in which the P gain is controlled to a large gain constant to a small gain constant in a stepless manner.

For example, when the P gain is changed to the large, middle, or small gain constant among three steps, in particular, the P gain may be set to the large gain constant in place of the middle gain constant in S6 shown in FIG. 2 or FIG. 7. Further, when it is determined that the fuel cut is being performed, the P gain may be set to the middle gain constant in place of the larger gain constant. There has been described the embodiment in which the P gain is set to the small gain constant in the idling state, but the P gain may be set to the middle gain constant. In short, the P gain need only to be set to a value larger than a minimum value (here, the small gain constant).

As for the FPC 3, the engine ECU 2, and the HVECU 21, two or more devices of them may be included integrally or may be included separately, in other words, the functions mounted in the respective electronic control devices 3, 2, 21 may be performed separately by electronic control devices 3, 2, 21 or may be performed by the same electronic control device. There have been described the embodiments in which the present disclosure is applied to the internal combustion engine 13 of a diesel engine. However, the present disclosure is not limited to this but may be applied to an internal combustion engine of a gasoline engine.

The configurations and the processing contents of the embodiments described above may be combined with each other.

Further, the present disclosure has been described on the basis of the embodiments described above but it should be understood that the present disclosure is not limited to the embodiments and the structures described above. The present disclosure includes various modifications and variations within an equivalent scope. In addition, various combinations and modes of the modifications and variations and other combinations and modes including one element or more of the modifications and variations are also included within the scope and spirit of the present disclosure.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A fuel pump control device comprising:

at least one memory; and at least one processor coupled to the memory and configured to perform a feedback control of an actual fuel pressure of a fuel pump, which is to supply fuel to an internal combustion engine of a vehicle, to a command target fuel pressure from an external element; and to change a gain for the feedback control to a value larger than a minimum value in response to an acceleration command information which is to accelerate the vehicle by using the internal combustion engine.

2. The fuel pump control device according to claim 1, wherein the at least one processor is configured to set the gain to a large value in response to the acceleration command information which is received before receiving a command to increase the command target fuel pressure from the external element.

3. The fuel pump control device according to claim 1, wherein the at least one processor is configured to increase the gain to a large value on determination that the internal combustion engine is stopped based on a vehicle speed information, which indicates a speed of the vehicle, or based on an engine speed information of the internal combustion engine.

4. The fuel pump control device according to claim 1, wherein the at least one processor is configured increase the gain on determination that the internal combustion engine is in a state of fuel cut.

5. The fuel pump control device according to claim 1, wherein the at least one processor is configured to increase the gain on determination that the internal combustion engine holds a constant torque exceeding a torque in an idling state.

6. The fuel pump control device according to claim 1, wherein the at least one processor is configured to decrease the gain on determination that the internal combustion engine is in an idling state when the internal combustion engine holds a torque corresponding to a torque in an idling state.

7. The fuel pump control device according to claim 1, wherein the external element is an engine ECU, and the engine ECU is configured to receive a sensor signal same as a sensor signal used for controlling the internal combustion engine and to send the acceleration command information based on the sensor signal.

8. The fuel pump control device according to claim 1, wherein the at least one processor is configured to make a determination on the acceleration command information based on an accelerator sensor signal.

9. The fuel pump control device according to claim 1, wherein the at least one processor is configured to make a determination on the acceleration command information based on an engine drive request signal.

10. The fuel pump control device according to claim 1, wherein a high-pressure fuel pump is configured to supply fuel to a fuel injection valve, and the fuel pump is a low-pressure fuel pump configured to pressurize fuel accumulated in a fuel tank to supply the fuel to the high-pressure fuel pump through a low-pressure pipe.

11. The fuel pump control device according to claim 1, wherein the at least one processor is configured to change the gain to a value not less than the minimum value during operation of the internal combustion engine.

12. A method for controlling a fuel pump control device, comprising:

performing a feedback control of an actual fuel pressure of a fuel pump, which is to supply fuel to an internal combustion engine of a vehicle, to a command target fuel pressure; and changing a gain for the feedback control to a value larger than a specified minimum value in response to an acceleration command information which is to accelerate the vehicle by using the internal combustion engine.

* * * * *